United States Patent [19]

Olsen et al.

[11] 4,130,871

[45] Dec. 19, 1978

[54] BRIDGE GAME SCORING AND DISPLAY COMPUTER

[76] Inventors: James R. Olsen, Shawsheen Rd., Bedford, Mass. 01730; Charles R. Forth, S. Mission St., La Habra, Calif. 90631

[21] Appl. No.: 842,741

[22] Filed: Oct. 17, 1977

[51] Int. Cl.[2] ..... A63B 71/06

[52] U.S. Cl. ..... 364/411; 235/92 GA; 273/148 R; 340/323 R

[58] Field of Search ..... 364/410, 411; 235/92 GA; 273/1 E, 148 R, 148 A; 340/323 R

[56] References Cited

U.S. PATENT DOCUMENTS

| | | | |
|---|---|---|---|
| 3,001,703 | 9/1961 | Flam | 235/92 GA |
| 3,314,693 | 4/1967 | Flam | 273/148 R |
| 3,420,526 | 1/1969 | Berger | 273/148 R |
| 4,030,764 | 6/1977 | Mattos | 235/92 GA |
| 4,073,493 | 2/1978 | Moreland | 273/148 R |

FOREIGN PATENT DOCUMENTS 2449631 4/1976 Fed. Rep. of Germany ..... 235/92 GA

OTHER PUBLICATIONS

"Crowds See Bridge Game on Electric Board"; Popular Mechanics; Apr. 1935; p. 556.

*Primary Examiner*—Charles E. Atkinson
*Assistant Examiner*—Errol A. Krass
*Attorney, Agent, or Firm*—Robert T. Dunn

[57] ABSTRACT

An electronic computer for computing and displaying the scores of the parties engaged in conventional games of Bridge receives inputs before each hand of the winning bid, the party winning the bid, and whether the winning party is doubled or redoubled; and upon completing the hand, the computer receives inputs of the number of tricks taken during the hand by the party winning the bid and honor points awarded to either party; and the computer computes and displays whether either party is vulnerable, the total point score of each party and the partial scores of each party.

17 Claims, 6 Drawing Figures

NOTES: ALL NUMBERS ARE IN HEXIDECIMAL (BASE 16) NOTATION.
X STANDS FOR THE FOUR BIT CODE REPRESENTING THE DIGIT BEING DISPLAYED

READ ROUTINE

BRIDGE GAME SCORING AND DISPLAY COMPUTER

BACKGROUND OF THE INVENTION

The present invention relates to Bridge game scoring devices for computing and displaying the score in the game of Bridge and in Bridge-like games.

The card game Bridge using a conventional deck of (52) cards has been played in a number of versions. At present, the three most popular versions are Contract Bridge, Duplicate Bridge, and Chicago. For these three versions of bridge, play consists of a series of hands and each hand begins by an auction that consists of bids made by the players in rotation. The bid is won by the party bidding the highest for the hand. After the hand is played, trick points and premium points are awarded depending upon whether each party is vulnerable and depending on whether the party winning the bid was doubled or redoubled. In addition, in Contract Bridge, points are awarded to the party that first wins two games and in all bridge games such as Contract, Duplicate and Chicago, two scores are kept for each party, the partial score or game score and the total point score.

The complexities of bidding in any of the games of bridge are formidable and many books have been written advising bridge players on how to bid. Score keeping is complicated and some players will confess, after playing for many years, they still do not know how to keep score.

Heretofor, considerable effort has been made to provide appartus manipulated by the players in a game of bridge for displaying the bids so that each players bid is displayed to all the other players, the purpose being to eliminate verbal communication between the players during bidding. Efforts have been made to provide game scoring mechanisms that display each party's score. However, they are not automatic and do not automatically compute and display vulnerability, trick points and premium points; they display only what the operator sets them at and, hence, they are score keepers and displays rather than score computers and they do not relieve the players of the burden of calculating the scores at the end of each hand.

SUMMARY OF THE INVENTION

It is an object of the present invention to provide apparatus for computing and displaying the scores of the parties in a game of Bridge requiring only decision inputs from the parties.

It is another object to provide such appartus wherein limitations of prior appartus for displaying the scores of parties in a game of Bridge are avoided.

It is an object of the present invention to provide a special purpose digital computer computing the scores of the parties in a game of Bridge.

It is another object to provide such a special purpose digital computer having a manually operated key board input for designating the declaring party's bid at the beginning of a hand and the number of tricks taken by the declaring party over or under book at the end of the hand.

It is another object in conjunction with the above to provide such a computer having manually operated inputs for designating whether the declaring party is doubled or redoubled at the beginning of a hand and whether either party holds honors in their hand.

It is a further object to provide such a computer that displays the total point score for each party, the partial score and vulnerability of each party, the bid of the declaring party and whether the declaring party is doubled or redoubled.

In accordance with principle features of the present invention, an electronic device is provided, preferrably consisting of a key board, a display and digital computer circuits, the key board being manually operated to initiate electrical signals in circuits representative of the bid of the declaring party at the beginning of a hand, the same circuits being used to initiate signals representative of the tricks taken by the declaring party over or under book at the end of the hand at which time the computer in response to the initiated signals computes the scores of both parties and energizes the displays that present the scores.

In preferred embodiments of the present invention, the partial score or game score as well as the total point score and vulnerability of each of the parties in the game are computed and displayed. In addition, the declaring bid is displayed and whether the declaring party is doubled or redoubled is also displayed.

These and other objects and features of the present invention together with others inherent in the same are attained by the device illustrated in the following drawings and which represent the best known use of the invention.

DESCRIPTION OF THE EMBODIMENTS OF THE INVENTION

Scoring Rules in Games of Bridge

Figure 1:
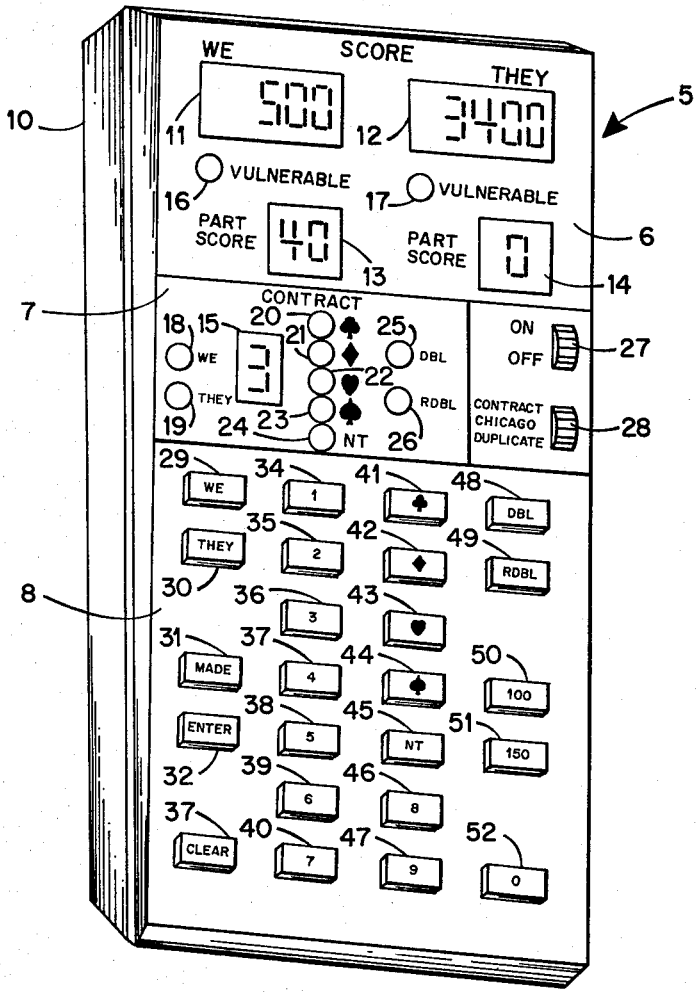
FIG. 1 is a front perspective view of the computer housing, keyboard and display for automatic scoring and display.

Bridge is a card game using a conventional deck of (52) playing cards whereby partnerships compete for points which are assigned as a result of the number of tricks taken during play and other factors. Three currently popular versions of bridge are Contract Bridge, sometimes referred to as Rubber Bridge, Duplicate Bridge and Chicago, sometimes referred to as Four-Hand Bridge. Play and scoring of these versions of Bridge are similar with differences occurring in the play and the scoring accounted for by differing objectives of each game. More particularly, Contract Bridge is usually played by two partnerships (four players in all) who plan to play for several hours; whereas, Duplicate Bridge is designed for tournament play involving many players or teams; and Chicago is suited for situations in which it is desired to limit the duration of play to under 30 minutes or so.

For all of these three versions of Bridge, play consists of a series of hands, each hand consisting of an auction and subsequent play. The auction consists of bids made by the players in rotation, each bid being restricted to one of the following:

1. A call of a number of tricks to be taken in excess of 6 (6 being called book) and either a "trump" suit or "no trump";
2. A call of "double" by an opponent of a player making a suit bid;
3. A call of "redouble" by a player after an opponent's double; or
4. A call of "pass".

Every auction is won by the partnership that bids the highest for the hand and the player of that partnership who first named the trump suit during the bidding becomes the "declarer" once the bidding has ended. The declarer's partner places his cards face up after the opponents first lead and the declarer plays both hands of his partnership. During the play and when scoring a hand the declarer's partnership is called the offence and his opponents are called the defense. If the declarer takes at least the number of tricks contracted for by the winning bid (in addition to the book of six tricks), his team receives trick points for each trick point bid and and taken. His team also receives premium points for tricks taken beyond those bid and called over tricks and for small slams, grand slams, and for making a bid that has been doubled. Only trick points are counted toward completion of a game which is made when a cumulative trick point score of 100 or more points is made. Making a contract which does not complete a game is asigned a score known as a part score.

In Contract Bridge, part scores are carried into successive hands until one of the partnerships accumulates 100 or more points to complete a game. The first team to win two games wins a Rubber and scores additional premium points. A team is vulnerable after it has won a game during the course of a Rubber.

When playing Duplicate Bridge, each team is assigned a vulnerable or a non-vulnerable condition at the beginning of each hand. Each hand is scored independently of the results of previous hands and no part scores are carried forward; but rather, premiums are scored for making part scores and games.

In Chicago Bridge, a Rubber always consists of 4 hands. Part scores are carried forward until a game is scored by one of the teams or until the Rubber is finished. Vulnerability is assigned based on which hand of the Rubber is being played, with neither team vulnerable on the first hand, one team vulnerable on hands three and two, and both teams vulnerable on hand four.

It is common practice to identify the partnerships in any of the games of Bridge as WE and THEY. Clearly, the object of the game is to score more points than one's opponents. A Rubber is the best of three games and, in Contract bridge, the side that wins two games, wins the Rubber. At the end of the Rubber, the score is added up and it is possible to win the Rubber and yet to be a loser, because points are scored both in offense and in defense. An important element of the strategy of the game is deciding when it is worthwhile to incur loss rather than surrender a game and that decision, of course, is made in view of the rather complicated rules of scoring. Clearly, a computer that would immediately reveal to a player the score that would result for both parties in the event he makes a bid or fails to make a bid, whether doubled or redoubled, and vulnerable or invulnerable, would be very useful to the player.

The play of a hand is, very briefly, as follows: the player to the right of the dealer plays a card face up. Then the declarer's partner lays his hand down face up (called the dummey hand). And cards are played in sequence to complete the trick. If the declarer or the dummey hand wins the trick, the declarer gathers the cards of the trick to his side and if the defending side wins the trick, then one of the partners of that side gathers the cards of the trick to his side. The dummey takes no part in the play, because the declarer plays the dummey hand.

Each card played must follow the suit of the first card played unless the player has no cards of that suit and in that case the player may play any card in his hand including a trump card. If all cards in the trick are the same suit then the highest card wins the trick. On the other hand if one or more trump cards are played in the trick then the highest trump card wins the trick.

Every trick taken by the declarer in excess of book (6 tricks) is counted at the end of the hand and the points are given for each trick depending on the declarer's bid. And depending upon whether the declarer is doubled or redoubled. These points go toward game for the declarer's partnership and is called the part score, game score, or score below the line. The points gained for tricks taken over book, under the circumstances of no doubling, doubled and redoubled are shown by the chart below.

CHART I

| | | | Doubled | | Redoubled | |
|---|---|---|---|---|---|---|
| | First Trick | Subsequent Tricks | First Trick | Subsequent Tricks | First Trick | Subsequent Tricks |
| Clubs | 20 | 20 | 40 | 40 | 80 | 80 |
| Diamonds | 20 | 20 | 40 | 40 | 80 | 80 |
| Hearts | 30 | 30 | 60 | 60 | 120 | 120 |
| Spades | 30 | 30 | 60 | 60 | 120 | 120 |
| No Trump | 40 | 30 | 80 | 60 | 160 | 120 |

Premium points, also called the score above the line, can be gained by both the offense and the defense parties in the play of the hand. The premium points gained by the declaring party for making a doubled bid (also called a double contract) and for making a small slam (6 tricks over book) or a grand slam (7 tricks over book) while not-vulnerable and while vulnerable are shown by Chart II below.

CHART II

| | Not Vulnerable | Vulnerable |
|---|---|---|
| Doubled Contract | 50 | 50 |
| Small Slam | 500 | 500 |
| Grand Slam | 1000 | 1000 |

Over tricks also gain a premium of points for the declaring partnership depending on whet-er that partnership is doubled or redoubled, vulnerable or not vulnerable. These points are shown by Chart III below.

CHART III

| | | Premium For Each Overtrick | | | |
|---|---|---|---|---|---|
| | | Doubled | | Redoubled | |
| | | Not Vulnerable | Vulnerable | Not Vulnerable | Vulnerable |
| Clubs | 20 | | | | |
| Diamonds | 20 | | | | |
| Hearts | 30 | 100 | 200 | 200 | 400 |
| Spades | 30 | | | | |
| No Trump | 30 | | | | |

The defensive party is awarded premium points when the declaring party fails to make the bid. This is by way of a penalty against the offensive party for under tricks and is awarded to the defensive party. Chart IV shown below lists the points awarded the defensive party for each under trick and when the bid was doubled or redoubled and the offensive party vulnerable and not vulnerable.

CHART IV

| | | Doubled | | Redoubled | |
|---|---|---|---|---|---|
| | Each Trick | First Trick | Subsequent Trick | First Trick | Subsequent Trick |
| Not Vulnerable | 50 | 100 | 200 | 200 | 400 |
| Vulnerable | 100 | 200 | 300 | 400 | 600 |

Premium scores are also awarded to the party upon completing a game or a Rubber. These premiums are different for Contract, Duplicate and Chicago Bridge as shown by Chart V below.

CHART V

| | Contract Bridge | Duplicate Bridge | Chicago Bridge |
|---|---|---|---|
| Part Scores | zero | 50 | 100* |
| Game, Not Vulnerable | zero | 300 | 300 |
| Game, Vulnerable | zero | 500 | 500 |
| Two Game Rubber | 500 | | |
| Three Game Rubber | 700 | | |

*If part score is made on last hand

In Contract Bridge, where the Rubber is unfinished, the winner of one game gets a score of 300 points and if only one side has a part score in a unfinished game, that side gets a score of 50 points.

Honor premiums can be awarded at the end of a hand to either party. If one of the hands of the party holds 4 trump honors (an honor is the Ten, Jack, Queen, King or Ace of trump or any Ace in a no-trump bid) honor points are awarded as shown by Chart VI.

CHART VI

| | Any Four Honors In One Hand | All Honors In One Hand |
|---|---|---|
| Suit Bid | 100 | 150 |
| No Trump Bid | — | 150 |

Clearly, from the above charts, doubling and redoubling does not affect honor, slam, or rubber points and vulnerability does not affect the points for honors. It is also clear, that scoring following each hand of Bridge whether it be Contract, Duplicate, or Chicago Bridge is complicated. The embodiment of the present invention described herein enables the players to keep score requiring only decision inputs from the players. In other words, the players need only enter an input indicating which party wins the bid, the winning bid, and whether the winning bid is doubled or redoubled. Then the parties play the hand and after all tricks are played, it is only necessary to enter an input of how many tricks over book are made by the offensive party and to enter honors for either party. When those entries are made, the device automatically calculates and displays for each party identified as WE and THEY, total points scores, partial score and whether or not the party is vulnerable. In addition, after the declarer's bid is entered, and whether the bid is doubled or redoubled, the bid is displayed and the doubling or redoubling is displayed. This device, as illustrated by FIG. 1 may be the size of a hand calculator and manipulated by any of the players of the game. It provides at all times a display of the winning bid and whether that bid is doubled or redoubled. It also displays the total point score and partial score for each party and vulnerability. It virtually eliminates the need to list and add scores above and below the line as done in the past, as all of that is done automatically.

Automatic Bridge Score Calculator and Display

Turning first to FIG. 1 there is shown a perspective view of the Automatic Bridge Calculator for calculating bridge scores during a game. This shows a suitable format for the housing, the displays, the switches, and keys for input. The housing is preferrably the size of a conventional hand calculator. Clearly there are other formats that could be used and the housing could be larger such as for a desk top size calculator or the complete system could be contained in several housings, depending on the use intended. In FIG. 1, the housing 10 has a front face 5 on which are the Score Displays 6, Contract Displays 7 and the Input Keyboard 8. The displays 6 and 7 include windows 11 to 15 for displaying by means of, for example, light emitting diodes or liquid crystal displays, or some other visual display the WE and the THEY partnership scores and the number of tricks bid for the current contract being played. The displays on the front face also include indicator lights 16 to 26 for displaying the vulnerable condition of each of the two parties or teams the elements of the current contract being played consisting of a WE or THEY indication identifying the team that bid the contract, the suit bid or a no-trump indication and whether the contract was doubled or redoubled.

For each of the two parties in the game, identified as WE and THEY, a five digit display 11 and 12, respectively, is used to show the parties total cumulative point score. According to the rules for Contract Bridge already described, these total point scores do not include a part or partial score which has not been cleared by the completion of a game. Thus, each of the parties WE and THEY has a two-digit part score display, 13 and 14 respectively, which is used in Contract Bridge and Chicago Bridge to display the part scores that count toward scoring a game in succeeding hands. It should be understood that, changed so that the part scores are included in the total point scores, an accomodation can be made in the computer for easily accomplishing that.

Indicators that a party is vulnerable are indicators 16 and 17. These indicate, when energized, that the parties WE and THEY are vulnerable. When the indicator is not energized, the indication is that the party is not vulnerable. These indicators are updated automatically when the calculator is used for Contract Bridge or for Chicago Bridge. In Contract Bridge the calculator indicates that a party is vulnerable whenever it scores a game, but does not complete the Rubber. For Chicago Bridge, the calculator updates vulnerability based on which hand of a Rubber is being played. For example, in Chicago Bridge:

For the first hand, neither party is vulnerable;

For the second hand, the WE party is vulnerable;

For the third hand, the THEY party is vulnerable; and

For the fourth hand, both parties are vulnerable. In Duplicate Bridge, vulnerability is entered manually as will be described more fully below.

On front face 5 of the housing is also included the on/off switch 27 and a game switch 28 that is used to select the scoring for Contract Bridge, Chicago Bridge, or Duplicate Bridge, whichever the parties are playing. The Input Keyboard 8 also called the control panel on the front face includes push-button keys 29 to 52 in the lower portion thereof. These keys are used to enter the Contract bid and the offensive or declaring party (WE or THEY) and whether the declaring party is doubled or redoubled, all before the hand is played. Then, after the hand is played, the same keys are used to enter the results of the play including honors. Thus the calculator automatically displays the contract entered and, when the results of the play of the hand is entered, then computes and updates the scores on the displays according to the rules of scoring for the game selected.

Use for Contract Bridge Scoring

In Contract Bridge, the WE, THEY, and MADE keys 29, 30, and 31, the keys numbered 1 to 9 and 0, 34 to 40, 46, 47, and 52, the suit keys for clubs, diamonds, hearts, and spades, 41 to 44, the no-trump key 45, the doubled key, 48 denoted DBL, the redoubled key 49, denoted RDBL, the 100 honors key 50, denoted 100 and the 150 honors key 51, denoted 150, are all used to enter bids and play results called inputs to the system. These inputs are all decision inputs made by the players based upon the play action and, of course, cannot be programmed because they are continually changing during play and cannot be anticipated. Hence, these inputs are variable. After the auction is complete, and one or the other of the parties has won the bid, the final contract is entered at the control panel 8, as follows:

1. Enter WE or THEY to indicate the party that won the contract. This will clear the previous bid from the bid display 15 and from the indicator lights 18 through 26, and will indicate the party winning the bid on indicator lights 15 and 19.
2. Then enter the number of tricks over book that are bid. This will be 1 to 7 and is entered using keys 34 to 40, the number on the key struck being displayed at 15 in the Control Display 7.
3. Then enter the suit bid or no-trump by striking one of the keys 41 to 45 causing one of the indicator lights 20 to 24 that represents the suit to illuminate.
4. At that time, if the bid was doubled and/or redoubled strike the DBL key 48 and/or the RDBL key 49. This will cause indicator lights 25 and/or 26 to be illuminated.

After the hand is played and all tricks are taken by one or the other of the parties, the score for that hand is computed by entering the following:

1. First, strike MADE key 31 and then strike the numbered key indicating the number of tricks over book taken by the offense using keys 34 to 40 or 52; or
2. If fewer than 6 tricks were taken by the declarer, strike the MADE key twice and then strike keys indicating the actual number of tricks taken using keys 34 to 38.
3. Enter any honor points. These can be entered either after the bid is entered or after the play results are entered by striking the 100 key, 50 or the 150 key, 51 to indicate the number of honor points to be scored for the offense. Honor points for the defense must be entered after the play results have been entered and they are entered by striking the WE key, 29 or the THEY key, 30 to identify the team to which honor points are to be scored and then striking the 100 key or the 150 key to indicate the number of honor points to be scored.

As soon as the play results and honor points are entered the scores for WE and THEY are presented by displays 11 to 14. Thereafter, these displays are automatically updated to reflect the score throughout play.

Duplicate Bridge bids and play results are entered in the same way as they are for Contract Bridge except that in Duplicate Bridge play the vulnerability of each team must be entered. It is not computed automatically as for Contract Bridge. The vulnerability of each team is indicated by lights 16 and 17 and can be changed (turned off or on) by the following actions 1. Strike WE or THEY keys 29 or 30 to indicate which team's vulnerability is to be changed.
2. Then strike the ENTER key 32 three times. This changes the vulnerability indication for the selected team.

In Chicago Bridge bids and play results are entered in the same way they are for Contract Bridge.

The computer in the device is designed to automatically ignore the input from keys that are struck in an invalid sequence. For example, the number, suit, DBL and the RDBL keys are ignored until the WE or THEY key is struck. In order to provide flexibility, the number of tricks bid, the suit bid, DBL and RDBL entries for the bid may be entered in any order and an erroneous entry made when entering the bid may be corrected by striking the correct key in the case of the number and suit entries or by striking DBL or RDBL keys a second time in the case of a DBL or RDBL erroneous entry. Also, the MADE key will be ignored when a valid bid has not been entered for the hand being scored. Additional error handling and correction capability are provided by the CLEAR key, 33 and the ENTER key, 32. The CLEAR key, 33, nullifies the affects of the previous key (except the ENTER key as is described below). For example, if 100 honors is scored for the WE team by striking the 100 key, the CLEAR key will subtract 100 from the WE team's score if it is struck immediately after the 100 key. Similarly, if the following sequence of key entries is made; WE, 3, NT, 2, CLEAR, 3, the final results will be a score of 3 no-trump game for the WE team. The effect of the "2" is nullified by the CLEAR and the score is corrected by entering 3 at the end of the sequence.

Striking the CLEAR key 33 twice in a row will zero all numerical displays 11 to 15 and turn off all indicator lights 16 to 26. Striking the CLEAR key a third time in a row will restore displays 11 to 14 and indicator lights 16 and 17 to the condition that existed prior to the second CLEAR key entry.

The ENTER key 32 is used to enter total scores in displays 11 and 12, part scores in displays 13 and 14 and change vulnerability indicators 16 and 17 directly. This is done as follows and this sequence may be initiated at any time.

1. Entries are made for the team indicated by the illumination of the WE or THEY lights 18 or 19, respectively. The WE or THEY indication is changed if necessary by striking the WE or THEY keys 29 or 30 either before or immediately after step 2 below.
2. Strike the ENTER key 32.
3. Enter the total score for the indicated team by entering up to 5 digits using keys 34 to 40, 46, 47, and 52. The number entered will be displayed in one of the displays 11 or 12 corresponding to the WE or THEY lights 18 or 19.
4. Strike the ENTER key 32 a second time if the part score for the selected team is to be changed.
5. Enter the part score using the number keys, up to two digits.
6. If the vulnerability is to be changed, then strike the ENTER key a third time. The indicator light 16 or 17 will be changed for the selected team. If the CLEAR key 33 is struck during the enter sequence, the results of the entire sequence will be nullified. After completing an ENTER sequence, scoring entries continue with a bid entry.

It should be noted that the MADE key 31 has two functions, the ENTER key 32 has three functions and the CLEAR key 33 has two functions. This assignment of multiple functions to these keys with seldomly used functions requiring multiple strikes on MADE, ENTER, and CLEAR keys to identify secondary functions is made for aesthetic reasons to simplify the layout of the keyboard. An alternate implementation is to add 4 keys to the keyboard to perform the above mentioned secondary functions. For example, additional keys could be provided to perform the secondary functions as follows:

A NUMBER TRICKS key could be added replacing the second MADE key function.

An ENTER PART SCORE key added to replace the second ENTER key function.

A CHANGE VULNERABILITY key added to replace the third ENTER key function. A CLEAR ALL key added to replace the second CLEAR key function.

Computer Construction and Operation

Figure 2:
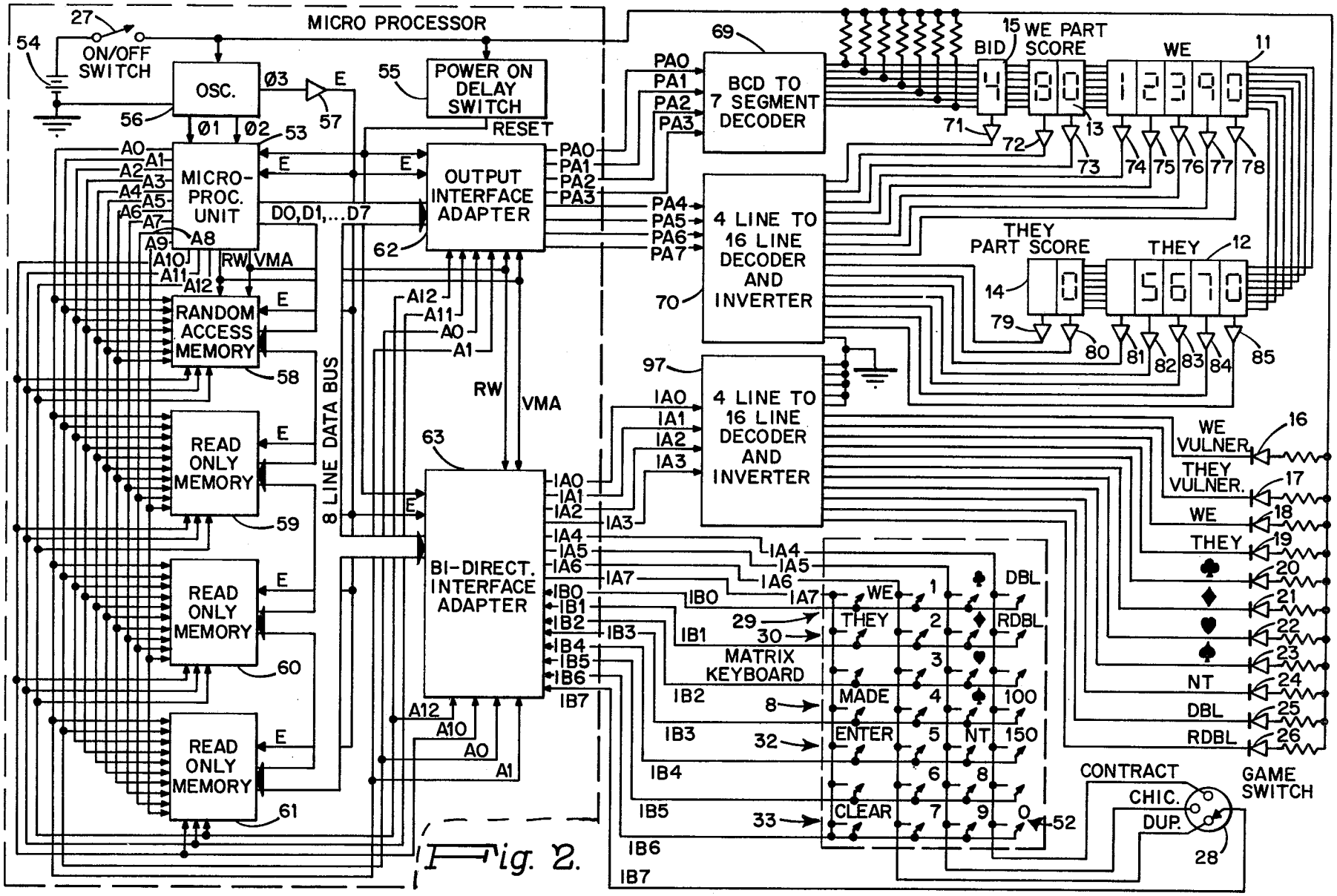
FIG. 2 is an electrical schematic diagram partially in block form illustrating the electrical elements of the keyboard input, the computer and the display all contained in the housing shown in FIG. 1.

FIG. 2 is a circuit diagram partially in block diagram form of the digital computer in the automatic bridge scoring calculator. This computer includes a micro processing unit calculating chip 53 and an associated power supply 54, timing signal sources 56 and 57, a start up signal generator 55, a read/write random access memory (RAM)module 58, organized as 128 eight bit bytes, read only memory (ROM) modules 59 to 61 each organized as 1024 eight bit bytes, and interface adaptors 62 and 63. These units taken together constitute a micro processor. The micro processing unit 53 has the capability to execute instructions stored in the ROM modules 59 to 61, and, as directed by those stored instructions, to perform the following functions:

1. Make signed additions to members with magnitudes up to 99999, in either decimal form or in binary form (in the latter case the capability must exist to convert from binary based numbers to decimal numbers).
2. Determine which of two numbers is the larger.
3. Determine whether or not two numbers are equal to each other.
4. Modify the sequence of instruction execution (called Branching) based on the determinations made using the capabilities defined in 2 and 3 above.
5. Assign calculated values to locations in the RAM.
6. Perform logical AND, INCLUSIVE OR, and COMPLIMENT operations on specified bid fields.
7. Read/write through appropriate interfaces to keyboard, displays and lights. There are several micro processor units commercially available all of which have the capabilities listed in 1 through 7 above. These capabilities are the minimum capabilities which are required for this embodiment of the present invention. Many micro processor units presently available have these and additional capabilities. The exact nature of the micro processor equipment 53 to 63 depends on the selection of the micro processing chip. Also, the number of lines used for date transfer (typically 4, 8 or 16) and interconnections required between the micro processing chip and associated equipment 55 to 63 depend on the micro processing chip selection. However, one skilled in the art of implementing micro processor based systems can determine interface requirements for the associated equipment 55 to 63. Implementation shown in FIG. 2 is based on the selection of a particular micro processor chip known as Motorola M6800, a product of Motorola Corp. Other implementations may combine some of the associated equipment 55 to 63 on the same chip as the micro processing unit 53 or, may combine all of the functions on a single custom produced chip.

The micro processor chips 53 and 55 to 63 are powered by a direct current power supply 54. Only one voltage is required from this power supply, although in other implementations several voltages may be required as specified by the manufacturer. The ON/OFF switch 27 connects the power supply to the circuit when the switch is closed.

A power on delay switch 55 holds the RESET line to ground for a delay time in accordance with the characteristics of the micro processor unit and allows the RESET line to transition to a high state (voltage different than ground). The RESET line transition serves as a signal to the micro processing unit 53 and the interface adaptors 62 and 63 to reset to an initial state and for the micro processing unit to begin executing stored instructions from a predetermined start up location in ROM 59 to 61. An oscillator 56 provides timing signals $\phi 1$ and $\phi 2$ to the micro processing unit 53. The memories 58 to 61 and the interface adaptors 62 and 63 are synchronized with the micro processing unit 53 through an enable signal in line E which is produced by oscillator 56 as signal $\phi 3$, current amplified by buffer 57 and sent to the micro processor unit 53 and 58 to 63.

Micro processing unit 53 executes instructions from ROMs 59 to 61 over the data bus which consists of eight lines designated D0, D1,–D7. The micro processing unit requests eight bit instructions signals (an instruction may include one or more segments) by transmitting the address of the next instructions to be executed to the ROMs 59 to 61 over the address lines A0, A1–A9. Lines A10 to A12 are used to signal which of the three ROM chips is to honor the request for an instruction segment. This process is called chip selection. Line A12 is put in a high state for all ROM accesses in order to differentiate ROM access from input or output requests through the interface adaptors 62 and 63 which are always accessed with A12 in the low state. Lines A10 and A11 are used to select one of the three memories 59 to 61 as follows:

When A10 is high and A11 is low — select chip 59
When A10 is low and A11 is high — select chip 60
When A10 is high and A11 is high — select chip 61

Some commercially available ROM chips can be produced to order so that they read chip select lines to the users specifications. Others must be fed by outputs from appropriate logic circuitry to implement selection as specified above. The arrangement of chip select lines to the ROMs 59 to 61 has the effect of assigning the three ROMs contiguous addresses from $1400_{16}$ (hexidecimal notation) to $1FFF_{16}$. Thus, the three ROMs 59 to 61 each containing 1,024 bytes, can be replaced by a single memory chip containing at least 3,072 bytes which would be interfaced using lines A10 and A11 as address lines rather than chip select lines.

A RAM 58, with the ability to both receive and send data is used to store and later retrieve, over the data bus D0 to D7, values computed as a result of micro processing unit 53 execution of instructions. Address assignments of $0000_{16}$ to $007F_{16}$ are made to the RAM 58 locations by connecting lines A10, A11 and A12 so that the chip is selected only if those lines are in the low state. The RAM 58 is also given a read/write direction over the RW line from the micro processing unit 53. The RAM 58 sends data to the micro processing unit over the date bus lines D0 to D7 when the RW line indicates a read condition and the valid memory address line (VMA) indicates that a valid address is present on the address lines. The location from which the memory obtains the data is of course specified by the address lines A0 to A6. Similarly, an RW indication of write will cause the RAM to accept data over the data bus and store it in the location specified on the address lines.

Two interface adaptors 62 and 63 provide for the transfer of data from the micro processor unit to and from the displays 6, indicator lights 7 and key board 8. One suitable implementation of the adaptors is to use commercially available programmable peripheral interface adaptors. Lines A10 to A12 are used to signals from the micro processing unit 53 to select the desired interface chip for data transfer. The VMA and E lines are used to synchronize the interface adaptors operations with that of the micro processing unit. The RW line is used to transfer a signal from the micro processing unit 53 to the interface adaptor 62 and 63, enabling data to be transferred from the micro processing unit to displays or indicator lights (during the Write phase) or from the key board to the micro processing unit (during the read phase). Lines A0 and A1 are used, when one or both are in the high state, to address certain registers in the adaptors which allow each of the lines PA0 to PA7, IA0 to IA7 and IB0 to IB7 to be defined as an input line or as an output line.

As an alternate technique, the adaptor 62 and 63 could be implemented using non-programmable interface adaptors, in which case lines A0 and A1 connections are unnecessary. Furthermore, custom integrated circuits could be used, in which case connections with lines RESET, E, A0, A1, A11, A12, VMA or RW may not be required for the interface adaptor. In operation of the system shown in FIG. 2, the output interface adaptor 62 receives data over the data bus lines D0 to D7 and generates signals which correspond to the signals along the lines on lines PA0 to PA7, respectively. The bi-directional interface 63 receives signals over the data bus lines D0 to D7 when the RW line indicates a write mode, and sends corresponding signals over lines IA0 to IA7, respectively. Simultaneously with the write operation, interface 63 reads lines IB0 to IB7 and holds the data received in internal registers. When this bi-directional interface 63 receives a read request as indicated by the RW signal, it sends the contents of said internal registers over the data bus lines D0 to D7 to the micro processing unit 53.

The micro processor unit 53 as described above, is used to perform scoring calculations based on inputs from the key board 8, and is used also to generate appropriate signals to the WE and THEY displays 11 to 15 and indicator lights 16 to 26 through decoders 69, 70, and 97 to display the results of recalculations. The displays 11 to 15 for the bid and the scores are seven segment displays in a multiplexed configuration. Seven segment displays are commercially available and are designed so that various combinations of seven signals will cause the display of any digit 0 through 9. The multiplexed configuration shown is a technique used to reduce the power requirements for driving the displays. In this multiplexed configuration, the display digits are pulsed one at a time by the micro processor so that only one digit is receiving power at any instant, but pulsed at speeds that make the display appear to be continuously lit to the human eye. The digit to be displayed is transmitted over lines PA0 to PA3 as a result of an instruction executed by the micro processing unit in binary coded decimal (BCD) form, which is a code used to represent digits from 0 to 9 using four bits. The BCD to seven segment decoder 69 uses the BCD code to determine which of the segment lines is set high. These segment signals are transmitted to each digit display 11 to 15. However, only one of all the digits is lit at a time. It is the digit whose output line is grounded. The line to be grounded is selected by a four line to sixteen line decoder 70, based on a binary coded signal which uses four lines PA4 to PA7 to represent a line selection of one of the sixteen output lines of the decoder. Current amplifiers 71 to 85 to drive the grounded display digit when it is selected.

If it should occur that the micro processor selected is not fast enough to pulse displays at a rate which will not cause an apparent blink, then, as an alternative, the displays can be driven by setting registers which in turn continuously drive the displays.

Indicator lights 16 to 26 are multiplexed in a manner similar to that used for the displays. These indicator lights are continuously supplied voltage, but are only grounded when selected by the four line to sixteen line decoder 97 with the line grounded being selected by the binary code appearing on lines IA0 to IA3, which, in turn, are set as the result of a instruction executed by the micro processor. Here again, it should be understood that the indicator lights could be continuously driven by a register-driven combination. Hence, as alternative, the decoder 97 could be replaced by a set of inverters and supply an interface line from the micro processor to each indicator light 16 through 26 separately.

Inputs are made via the keys 29 through 52 on the key board 8. The key board is a matrix key board laid out as shown in FIG. 2. The matrix technique is used to minimize the number of interface lines required for the key board. Four lines IA4 to IA7 are arranged and connected to one of the contacts of each key in a vertical column of the key board. Seven lines IB0 to IB6 are connected to the other contact of each key in a row. When one of the keys is depressed, one of the four vertical lines IA4 to IA7 is connected to one of the lines IB0 to IB6. The micro processor performs a write to each of the lines IA4 to IA7 in rotation, and, after each write operation, reads lines IB0 to IB7 to determine if a key is depressed and which key it is.

An alternate type of key board is one having one interface line for each key, so that when a key is depressed, the signal sent on its interface line to the micro processor will uniquely identify the key. It should be noted that four contacts in the matrix are not used and can be used to implement the four additional keys previously mentioned that are required to eliminate double function operation of MADE, ENTER, and CLEAR keys.

The game switch 28 is a 3-way switch that is connected to lines IA4 to IA6 and IB7 so that is appears to the micro processor as an additional row of the key board. The setting of this switch is read by the micro processor as part of the key board scan. Here again, the game switch could be connected to separate interface lines from a micro processor and read separately from the key board scan.

ROM Coding

The computer system shown in FIG. 2 has the capability of executing instructions permanently coded on ROM chips 59 to 61 and, with a suitable coded set of instructions, to perform the scoring computations in accordance with the rules given by CHARTS I to VI and energizes the displays and indicator lights which represent the scores of each of the parties and the current bid contract during the bridge game. In the circuitry, there are at the present time several commercially available ROMs that can be used. These ROMs can be coded using techniques such as metal-oxide-masking with machine instructions that are in a format suitable for retrieval and execution by the micro processing chip 53. These machine instructions have a format that is dependent on the particular micro processing chip 53 selected. Instructions normally include the following elements which are assigned specific bit locations in one or more bytes of memory in the ROM:

1. The operation code which defines an operation to be performed such as addition.
2. The code identifying micro processing chip internal registers which are to be operated on.
3. The addresses identifying locations of operands in the RAM 58, ROMs 59 to 61 and for some types of micro processors, interface adaptors.
4. The codes identifying methods for computing the addresses of the operands and certain aspects of controlling interface adaptor operations.

The requirements for defining the instructions are outlined by the diagrams of FIGS. 3, 4, 5 and 6 and by the detailed logic definitions listed hereinbelow under the subtitle MONITOR ROUTINE. A person of ordinary skill in the art of computer programming can, from the diagrams and logic definitions construct the machine instructions which, when coded on ROMs 59 to 61, will cause the micro processor to respond to keyed inputs to perform the Bridge scoring computations already described and display the Bridge score and bid indications also as already described.

Figure 3:
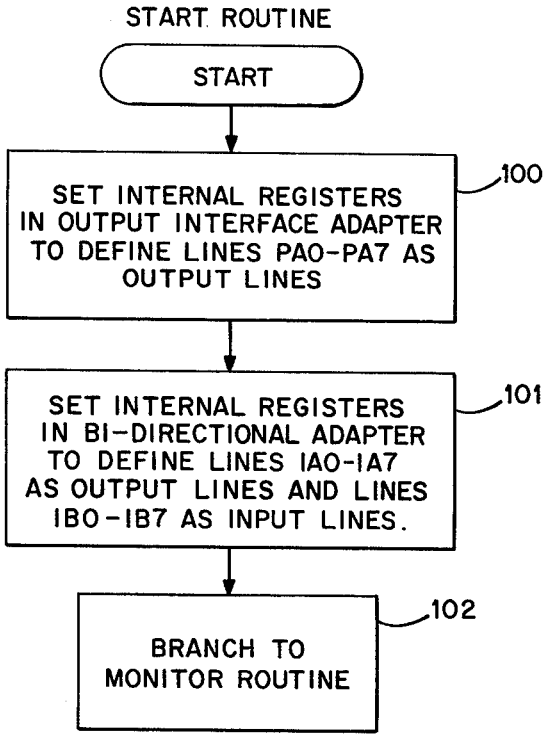
FIG. 3 is a diagram showing the sequence of instructions which are coded onto read only memories (ROM's) of the computer and which initiate operation, called the START ROUTINE.

Referring now to FIG. 3, when the RESET line transitions after power on, the micro processing unit 53 executes an instruction in ROMs 59 to 61 at a preset location. This instruction is coded to branch to a sequence of instructions that implement the logic shown by FIG. 3 and are referred to herein as the START ROUTINE. If programmable interface adaptors are used, the START ROUTINE must set internal registers of 100 and 101 in adaptors 62 and 63, respectively to define the interface lines as listed in FIG. 3. The START ROUTINE then branches at 102 to a sequence of instructions that implement the Bridge scoring computations, these instructions being referred to herein as the MONITOR ROUTINE and is described in detail herein below.

The MONITOR ROUTINE is defined in a language, widely used by those skilled in the arts of computor programming and known as PL/1. In the present embodiment, the MONITOR ROUTINE is written in PL/1 as defined in IBM system/360 operating system PL/1 (F), language reference manual, June 1970, IBM file No. S360–29. One deviation is made from this specification in that the program allows the use of lower case letters for variable and lable names. This is done to increase the readability of the program and does not affect the ability to convert the program into a suitable machine language. Two other extensions in the same catagory are the representation of "not equals operator" as $\neq$ and the use of a FORTRAN type computed GO TO statement with: GO TO (label 1, label 2 –) n where n is an integer that will cause a branch to the nth label in the parenthesized list of labels in the GO TO statement. The following naming conventions are used:

First, variable names ending in "light" indicate a variable used to drive an indicator light. Second, variables ending in "display" indicate a variable used to drive a display. Third, variables starting with "#" are representations of constants, Fourth, variables that start with a capital letter are used in more than one procedure, and Finally, labels that start with "$" are procedure names for key processing routines.

The process of converting a PL1 logic definition to machine executable instructions is a well known process called "compilation". This process can be either done manually or with the aid of a computer program known as a Compiler, which, when presented with a PL/1 logic definition, coded in a suitable format on computer readable media, such as punched cards, paper tape or via entries on a keyboard, the Compiler, being resident in a suitable general purpose computer, will translate PL/1 logic definitions to machine instructions suitable for execution by the selected micro processor.

Figure 4:
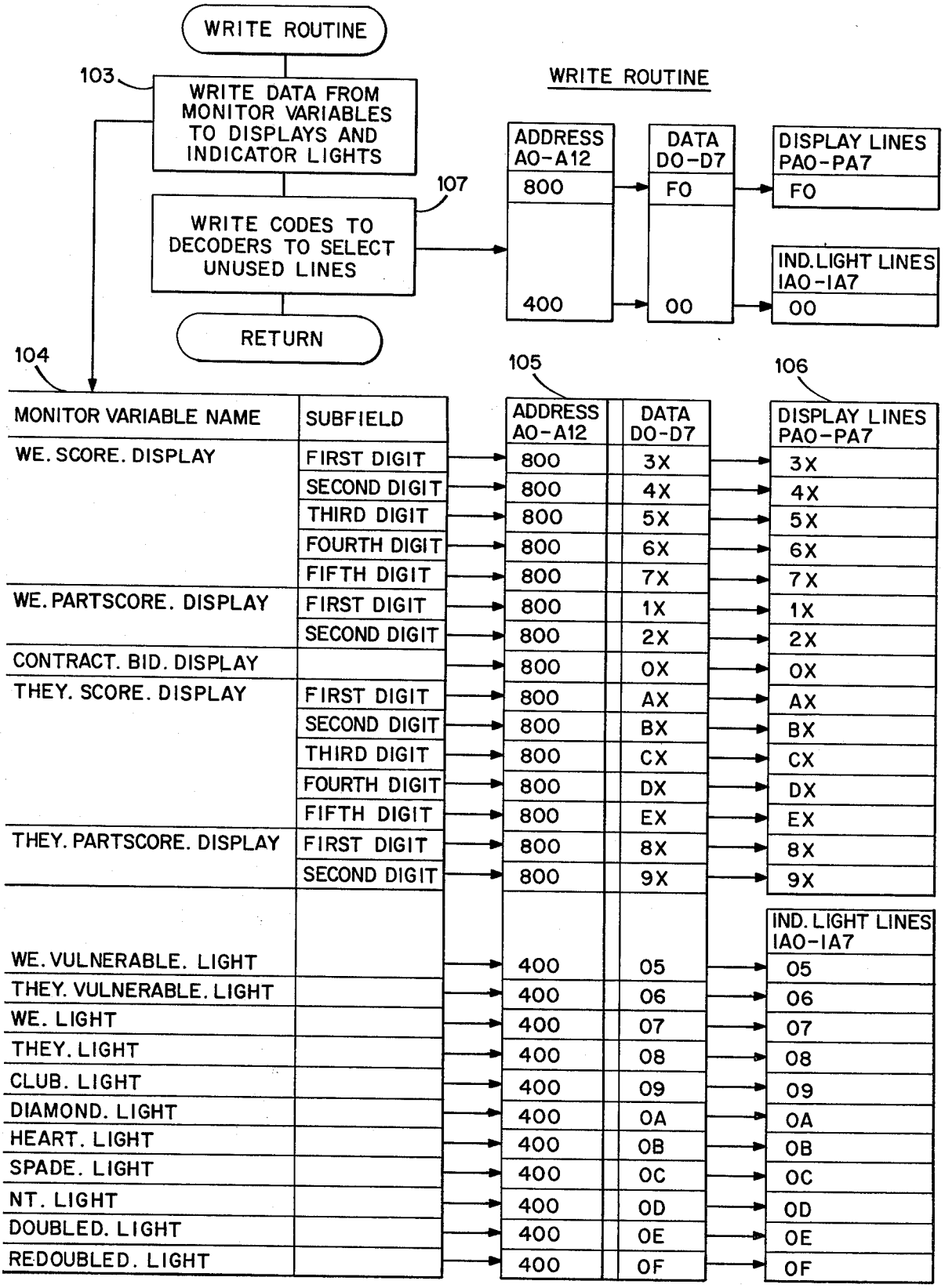
FIG. 4 is a diagram showing the sequence of instructions which when coded onto ROMs of the computer cause scoring computation results to be displayed, called the WRITE ROUTINE.

The PL/1 logic of the MONITOR ROUTINE set forth in detail hereinbelow, makes use of a set of instructions called the WRITE ROUTINE. A flow diagram of the WRITE ROUTINE is shown by FIG. 4. The routine contains instruction which, when executed, drive all of the displays and indictor lights. This is done by issuing appropriate instructions using the values and addresses shown in 104, 105, and 106. As a result, there is one signal for each display digit or indictor light. The WRITE ROUTINE then selects at 107 unused output lines to prevent the last display digit and light illuminated from being brighter than the others. It should be noted that the method used to translate score representations to display codes and the instructions used to transmit these signals to displays and indicator lights depends on the selection of the micro processing unit. Furthermore, if the alternate methods previously described herein for interfacing the displays and indicator lights with the micro processor are used in place of those shown in FIG. 2, then the addresses, data line signals, and display and indicator light signals will differ from those shown in 104 to 106.

Figure 5:
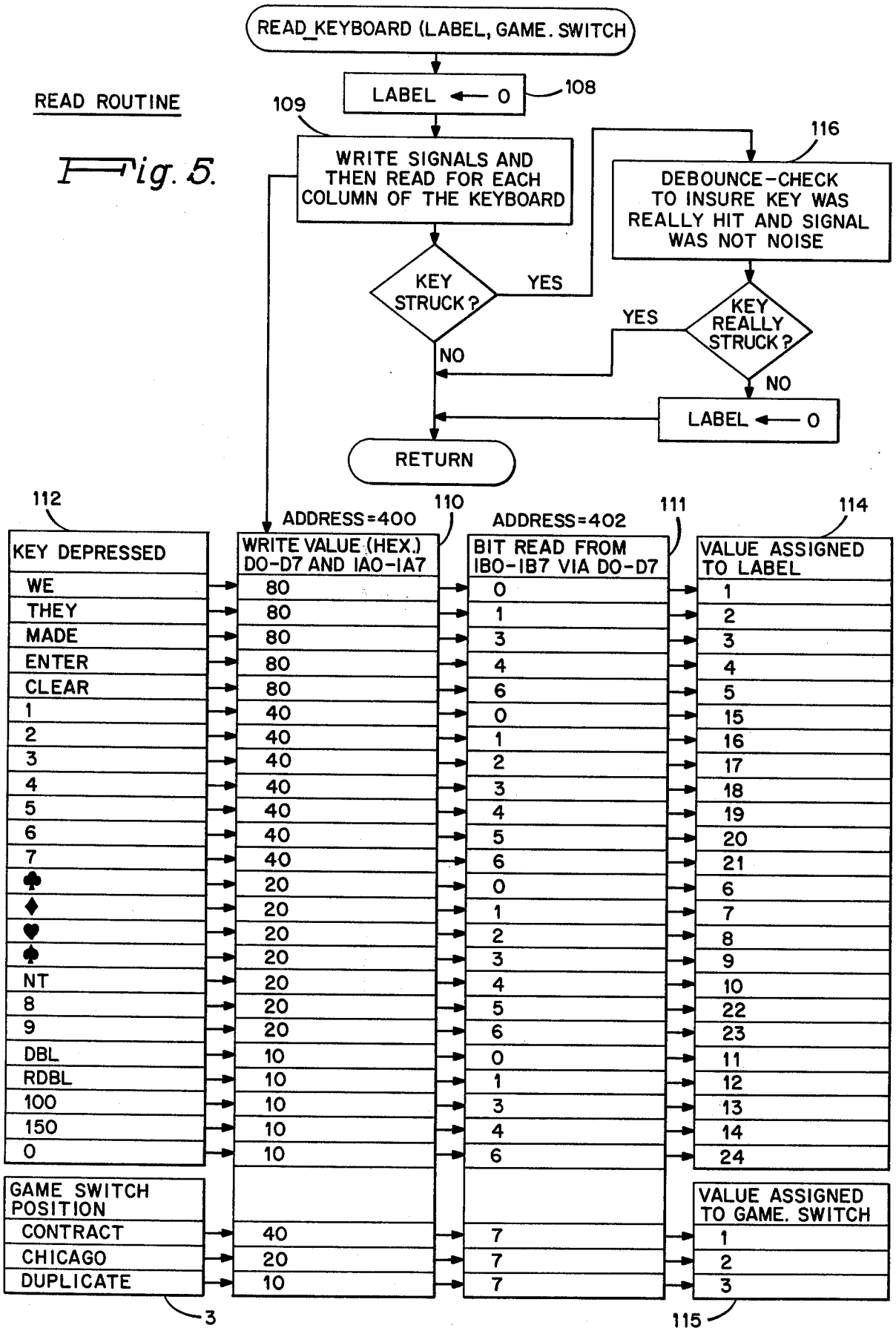
FIG. 5 is a diagram showing the sequence of instructions which when coded onto ROMs of the computer cause keyboard entries (inputs) to be recognized by the computer, called the READ ROUTINE.

The MONITOR ROUTINE also makes use of a sequence of instructions herein called the READ ROUTINE which scans the keyboard and sets a code to identify and key which is depressed and to identify the position of the game switch 28. The READ ROUTINE is represented by the flow diagram in FIG. 5. The results of this routine are communicated to the MONITOR ROUTINE via random access storage locations called LABEL and GAME SWITCH. The LABEL location has a value of zero if no key is depressed at 108. In FIG. 5 the READ ROUTINE initiates the steps at 109, sending signals over lines IA4 to IA7 (see FIG. 2) to 110. After each step of writing, the WRITE ROUTINE reads lines IB0 to IB7 at 111 to determine which Key at 112 is depressed and which game switch connection at 113 is made and sets the value of label at 114 and of GAME SWITCH 115 accordingly. If a key is struck, the routine must insure that the signal received resulted from a key depression and not from electronic noise. This is insured using a technique called DEBOUNCING at 116. It checks by doing more reading on the keyboard in a short time to insure that the key is depressed and does not recognize two signals from the same key, which occurs in a time shorter than a human normally holds the key down, as two separate strokes.

It should be noted that the requirement to write prior to reading the keyboard is eliminated if the alternate method previously discussed of providing an interface line from the micro processor to each key is implemented. The instructions, addresses and input/output techniques used for reading the keyboard and the game switch depend on the selection of the micro processing unit.

Operation

Figure 6:
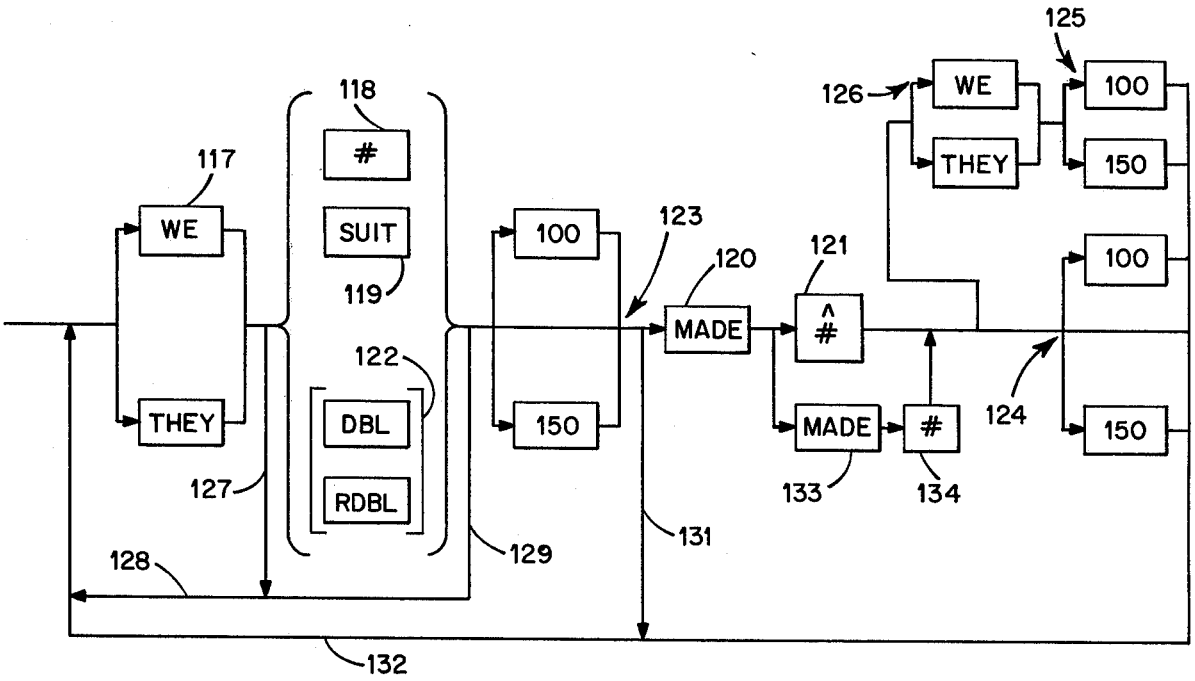
FIG. 6 is a diagram showing the sequence of the instructions which will be accepted by the computer.

Operation of the complete system including the keyboard displays and the computer shown in FIG. 2 according to the WRITE ROUTINE shown in FIG. 4 and the READ ROUTINE shown in FIG. 5 is according to the sequence illustrated by FIG. 6. Referring again in FIG. 2, when on/off switch 27 is turned on, the power on delay switch 55, after a suitable delay, issues the RESET signal to the micro processing unit 53 and the interface adaptors 62 and 63. These units clear all internal registers and the micro processing unit 53 fetches an instruction from a predetermined location in the ROMs 59 to 61. This instruction causes the micro processing unit to begin execution of the START ROUTINE shown in FIG. 3 which, in turn, puts the MONITOR ROUTINE described herein below in execution. The MONITOR ROUTINE sets all of the variables representing displayed values (those are variables with names ending in "display) and representing indicator light states (those variables with names ending in "light"), these variables being stored in RAM 58, to zero and off, respectively. The MONITOR ROUTINE described herein below then enters a continuous loop starting at the declaration label, which calls the WRITE ROUTINE shown in FIG. 4 and the READ ROUTINE shown in FIG. 5 during each pass through the loop. Also, during each pass through the loop, a signal is sent to each display digit 11 to 15 and each indicator light 16 to 26 by the WRITE ROUTINE. Also, during each pass through the loop, the keyboard is read as shown by the READ ROUTINE.

Since one pass through the monitor loop takes less than 400 micro seconds and since a person depressing a key holds the key down for at least 1500 micro seconds, any key depression will be detected. When a key depression is detected, the MONITOR ROUTINE leaves the loop and calls the key procedures corresponding to the key that is struck. The KEY PROCEDURES performs computations based on the key struck and the sequence of keys preceeding the current key depression.

The MONITOR ROUTINE described herein below, uses the Sequence · Flag variable as the primary control for recognizing valid sequences of key entries. FIG. 6 is a flow diagram of the sequences of key strikes which the MONITOR ROUTINE logic will accept and the sequence states represented by the values of the Sequence · Flag variable. As an example, assume that a bid and a play results are entered after turning on the calculator, the entry consisting of: WE, 3, NT, MADE, 5. In this sequence of entries, the WE key entry is accepted as the beginning of a bid sequence at 117. When the 3 key is depressed at 118 it is recognized by the MONITOR ROUTINE ($NUMBER Procedure) as a bid entry as opposed to a play result entry based on the fact that the Sequence · Flag indicates that a bid is being entered. The NT key entry at 119 completes the entry of the bid. Depressing the MADE key 120 causes transition into the MADE sequence. Thus, when the 5 key is struck at 121, it is recognized as a play result and the scoring calculations are done.

Meanwhile, if the DBL or RDBL key has been struck at 122, an appropriate increase in the bid entry is made and when Key 5 is struck at 121 the increase is added to the play result. Also, meanwhile, if the offensive party has honors and one of the honors keys 100 or 150 is struck at 123 before the MADE key, honors are recognized as a play result in the scoring calculations. Or, offensive honors can be added at 124 after the MADE key entry.

Defensive honors are added at 125 after the WE or THEY entry at 126 which follows the MADE # entries at 120 and 121. Defensive honors can be entered at 125–126 either before or after offensive honors are entered at 124.

As also illustrated by FIG. 6, any entry can also be corrected after it is struck. For example, after WE or THEY is struck at 117, one of these can be struck again to change the entry. This is shown in the figure by lines 127 and 128. Also, after striking # and suit at 118 and 119, WE or THEY can be struck again to begin again as shown by lines 129 and 128. The same can be done after MADE at 120 as illustrated by lines 131 and 132 and after offensive or defensive honors at 124 and 125, respectively, via line 132.

Correction can be made to a MADE # entry at 120 and 121 by striking MADE # again at 133 and 134. Following MADE #, offensive or defensive honors can be entered as already described, but if neither of these are entered, the score would stand as calculated at that point. On the other hand, at that point, if corrections were desired, striking the offensive party again at 117 would begin the whole entry again via lines 135 and 132.

Monitor Routine

The MONITOR ROUTINE defines all of the logic and calculations for the system shown in FIG. 2. The input and output is done by calling the READ and WRITE ROUTINES. The MONITOR ROUTINE is organized as follows:

First, there are DECLARATIONS of all variables.
Second, then the monitor controls start up and the read/write loop.
Third, then the key processing procedures commence, each procedure corresponding to a key or a set of keys.
Fourth, the second level procedures or utility routines are called by the key procedures.

When the calculator is turned on, control is passed to the monitor at the second of the above four parts of the program. Then, variables used to drive the displays and the lights are initialized and the monitor enters the read/write loop. When this occurs, the read and write procedures are called in the loop so that the displays and lights are continually refreshed and the key board is scanned. Then, when a key is struck the loop is left and the appropriate key procedure is called. The key procedure sets the indicators and performs calculations and updates the variables used to drive the displays and indicator lights. Then the loop is continued with the updated variables being used to drive the displays and lights.

The four parts of the organization of the MONITOR PROCEDURE described above are described in detail below. They are defined below as DECLARATIONS, MONITOR CONTROL, START UP AND READ WRITE LOOP, KEY PROCESSING PROCEDURES, and SECOND LEVEL PROCEDURES.

```
Monitor PROCEDURE ;

/*****************************************************************************/
/*          DECLARATIONS                                                     */
/*****************************************************************************/
DECLARE     1 Game,2 Switch                          FIXED BINARY(2);
DECLARE     1 We,  2 Score, 3 Display                FIXED BINARY(17),
                           3 State                   FIXED BINARY(17),
                 2 Vulnerable, 3 Light               FIXED BINARY(1),
                               3 State               FIXED BINARY(1),
                 2 Partscore,  3 Display             FIXED BINARY(7),
                               3 State               FIXED BINARY(7),
                 2 Light                             FIXED BINARY(1);
DECLARE     1 They LIKE We;
DECLARE     1 Contract, 2 Bid, 3 Display             FIXED BINARY(4);
DECLARE     1 Club, 2 Light                          FIXED BINARY(1),
            1 Diamond, 2 Light                       FIXED BINARY(1),
            1 Heart, 2 Light                         FIXED BINARY(1),
            1 Spade, 2 Light                         FIXED BINARY(1),
            1 NT, 2 Light                            FIXED BINARY(1);
DECLARE     1 Doubled, 2 Light                       FIXED BINARY(1),
            1 Redoubled, 2 Light                     FIXED BINARY(1);
DECLARE     1 Sequence, 2 Flag                       FIXED BINARY(3),
            1 Last,2Key, 3 Flag                      FIXED BINARY(4),
            1 Made, 2 Flag                           FIXED BINARY(1),
            1 Enter, 2 Flag                          FIXED BINARY(2),
            1 Clear, 2 Flag                          FIXED BINARY(1),
            1 Double, 2 Flag                         FIXED BINARY(1);
DECLARE     (n, nkey)                                FIXED BINARY(4),
            (points, premium)                        FIXED BINARY(16);
DECLARE     1 trick, 2 value                         FIXED BINARY(8),
            1 defense, 2 premium                     FIXED BINARY(16);
DECLARE     1 overtrick, 2 value                     FIXED BINARY(8),
            vulnerable                               FIXED BINARY(1);
DECLARE     1 defense, 2 vulnerable                  FIXED BINARY(1);
DECLARE     (#bid, #bidhonors, #endmade, #enter, #made, #madehonors) FIXED BINARY(3)
            INITIAL(1,2,      3,      4,      5,      6);
DECLARE     (#we,    #they, #madekey, #enterkey, #clearkey, #suitkey, #numberkey,
             #honorkey, #dblkey, #rdblkey)           FIXED BINARY(4)
            INITIAL(1,2,      3,      4,      5,      6,      7,
              8,      9,      10)
DECLARE     (#on, #off, #1, #2)                      FIXED BINARY(1) INITIAL(0,1,1,2);
DECLARE     (#contract, #chicago, #duplicate, #3)    FIXED BINARY(2) INITIAL(1,2,3,3);
DECLARE     Label                                    FIXED BINARY(5);

/*****************************************************************************/
/*          MONITOR CONTROL STARTUP, AND READ/WRITE LOOP                     */
/*****************************************************************************/
            /* ------ INITIALIZE ALL GLOBAL VARIABLES ----- */
            CALL Clear_Display;
            CALL Store_State;
            Last.Key,Flag = #we;
            Clear.Flag = #1;
```

```
                /* ------ REFRESH DISPLAYS AND SCAN KEYBOARD ----- */
Monitor_loop:   CALL Write;
                CALL Read_keyboard(Label, Game.Switch);
                IF Label = 0 THEN GO TO Monitor_loop;

                /* ------ CALL KEY PROCEDURE ----- */
                GO TO (We_call,They_call,Made_call,Enter_call,Clear_call,Club_call,Diamond_call,
                       Heart_call,Spade_call,NT_call,Dbl_call,Rdbl_call,X100_call,X150_call,
                       X1_call,X2_call,X3_call,X4_call,X5_call,X6_call,X7_call,X8_call,
                       X9_call,X0_call),  Label;
We_call:        CALL $WE;
                GO TO Monitor_loop;
They_call:      CALL $THEY;
                GO TO Monitor_loop;
Made_call:      CALL $MADE;
                GO TO Monitor_loop;
Enter_call:     CALL $ENTER;
                GO TO Monitor_loop;
Clear_call:     CALL $CLEAR;
                GO TO Monitor_loop;
Club_call:      CALL $CLUB;
                GO TO Monitor_loop;
Diamond_call:   CALL $DIAMOND;
                GO TO Monitor_loop;
Heart_call:     CALL $HEART;
                GO TO Monitor_lopp;
Spade_call:     CALL $SPADE;
                GO TO Monitor_loop;
NT_call:        CALL $NT;
                GO TO Monitor_loop;
Dbl_call:       CALL $DBL;
                GO TO Monitor_loop;
Rdbl_call:      CALL $RDBL;
                GO TO Monitor_loop;
X100_call:      CALL $100;
                GO TO Monitor_loop;
X150_call:      CALL $150;
                GO TO Monitor_loop;
X1_call:        CALL $NUMBER(1);
                GO TO Monitor_loop;
X2_call:        CALL $NUMBER(2);
                GO TO Monitor_loop;
X3_call:        CALL $NUMBER(3);
                GO TO Mointor_loop;
X4_call:        CALL $NUMBER(4);
                GO TO Monitor_loop;
X5_call:        CALL $NUMBER(5);        GO TO Monitor_loop;
X6_call:        CALL $NUMBER(6);        GO TO Monitor_loop;
X7_call:        CALL $NUMBER(7);        GO TO Monitor_loop;
X8_call:        CALL $NUMBER(8);        GO TO Monitor_loop;
X9_call:        CALL $NUMBER(9);      GO TO   Monitor_loop;
X0_call:        CALL $NUMBER(0);        GO TO Monitor_loop;
                END;

/*****************************************************************************/
/*              KEY PROCESSING PROCEDURES                                    */
/*****************************************************************************/

                /* ----- ENTER BID SEQUENCE AND TURN ON WE LIGHT ----- */
$WE:            PROCEDURE;
                IF Sequence.Flag = #made THEN RETURN;
                IF Last.Key.Flag ≠ #enterkey | Sequence.Flag ≠ #enter THEN Sequence.Flag = #bid;
                Last.Key.Flag = #we;
                CALL Clear_Contract;
                We.Light = #on;
                RETURN;
                END;

                /* ----- ENTER BID SEQUENCE AND TURN ON THEY LIGHT ----- */
$THEY:          PROCEDURE;
                IF Sequence.Flag = #made THEN RETURN;
                IF Last.Key.Flag ≠ #enterkey | Sequence.Flag ≠ #enter THEN Sequence.Flag = #bid;
                Last.Key.Flag = #they;
                CALL Clear_Contract;
                They_Light = #on;
                RETURN;
                END;
```

```
                /* ----- ENTER MADE SEQUENCE ----- */
$MADE:          PROCEDURE;
                IF Sequence.Flag = #endmade ! Sequence.Flag = #madehonors THEN RETURN;
                /* Insure that a valid contract has been entered */
                IF Contract.Bid.Display=0 ! (Club.Light=#off & Diamond.Light=#off &
                           Heart.Light=#off & Spade.Light=#off & NT.Light=#off) THEN RETURN;
                IF Last.Key.Flag = #madekey THEN Made.Flag = #2; ELSE Made.Flag = #1;
                Last.Key.Flag = #madekey;
                Sequence.Flag = #made;
                RETURN;
                END;

                /* ----- ENTER ENTER SEQUENCE, SET ENTER FLAG TO NUMBER OF TIMES ENTER
                          FLAG HAS BEEN HIT ----- */
$ENTER:         PROCEDURE;
                IF Sequence.Flag = #enter THEN
                     IF Enter.Flag = #2 THEN
                          BEGIN; IF We.Light = #on THEN
                                     IF We.Vulnerable.Light = #on THEN We.Vulnerable.Light=#off;
                                                                  ELSE We.Vulnerable.Light=#on;
                                 IF They.Light = #on THEN
                                     IF They.Vulnerable.Light=#on THEN They.Vulnerable.Light=#of
                                                                  ELSE They.Vulnerable.Light=#on
                                 Enter.Flag = #3;
                                 Sequence.Flag = #bid;
                          END;
                     ELSE BEGIN; Enter.Flag = #2;
                                 CALL Store_State;
                          END;
                ELSE BEGIN; Enter.Flag = #1;
                            CALL Store_State;
                            Sequence.Flag = #enter;
                     END;
                Last.Key.Flag = #enterkey;
                RETURN;
                END:

                /* ----- CLEAR EFFECTS OF LAST KEY, FOR TWO CLEARS IN A ROW, CLEAR DISPLAYS _ */
$CLEAR:         PROCEDURE;
                GO TO (Clear_we,Clear_they,Clear_made,Clear_enter,Clear_clear,Clear_suit,
                       Clear_number,Clear_honor,Clear_dbl,Clear_rdbl), Last.Key.Flag;

Clear_we:
Clear_they:     Sequence.Flag = #endmade;
                We.Light = #off;
                They.Light = #off;
                GO TO End_clear;

Clear_made:     IF Made.Flag = #1 THEN Sequence.Flag = #bid;
                Made.Flag = #1;
                GO TO End_clear;

Clear_enter:    IF Enter.Flag = #1 THEN Sequence.Flag = #bid;
                ELSE IF Enter.Flag = #2 THEN Enter.Flag = #1;
                     ELSE BEGIN; IF We.Light = #on THEN
                                     IF We.Vulnerable.Light = #on THEN We.Vulnerable.Light=#off;
                                                                  ELSE We.Vulnerable.Light=#on;
                                 IF They.Light = #on THEN
                                     IF They.Vulnerable.Light=#on THEN They.Vulnerable.Light=#of
                                                                  ELSE They.Vulnerable.Light=#on
                                 Enter.Flag = #2;
                                 Sequence.Flag = #enter;
                          END;
                GO TO End_clear;

Clear_clear:    IF Clear.Flag = #1 THEN
                     BEGIN; Clear.Flag = #2;
                            CALL Store_State;
                            CALL Clear_Display;
                     END;
                ELSE BEGIN; Clear.Flag = #1;
                            CALL Restore_Display;
                     END;
                GO TO End_clear;

Clear_suit:     CALL Clear_Suit;
                GO TO End_clear;
```

```
Clear_number:  IF Sequence.Flag = #bid THEN Contract.Bid.Display = 0;
               ELSE BEGIN; IF Sequence.Flag = #endmade THEN Sequence.Flag = #made;
                           CALL Restore_Display;
                    END;
               GO TO End_clear;

Clear_honor:   CALL Restore_Display;
               IF Sequence.Flag = #bidhonors THEN Sequence.Flag = #bid;
                                             ELSE Sequence.Flag = #endmade;
               GO TO End_clear;

Clear_dbl:     Doubled.Light = #off;
               Redoubled.Light = #off;
               Doubled.Flag = #1;
               GO TO End_clear;

Clear_rdbl:    Redoubled.Light = #off;
               IF Doubled.Flag = #1 THEN Doubled.Light = #off;

End_clear:     IF Last.Key.Flag ≠ #clearkey THEN Clear.Flag = #1;
               Last.Key.Flag = #clearkey;
               RETURN;
               END;

               /* ----- SUIT KEYS, IF IN BID SEQUENCE, LIGHT SELCETED SUIT LIGHT ----- */
$CLUB:         PROCEDURE;
               IF Sequence.Flag ≠ #bid THEN RETURN;
               Last.Key.Flag = Suitkey;
               CALL Clear_Suit;
               Club.Light = #on;
               RETURN;
               END;

$DIAMOND:      PROCEDURE;
               IF Sequence.Flag ≠ #bid THEN RETURN;
               Last.Key.Flag = #suitkey;
               CALL Clear_Suit;
               Diamond_Light = #on;
               RETURN;
               END;

$HEART:        PROCEDURE;
               IF Sequence.Flag ≠ #bid THEN RETURN;
               Last.Key.Flag = #suitkey;
               CALL Clear_Suit;
               Heart.Light = #on;
               RETURN;
               END;

$SPADE:        PROCEDURE;
               IF Sequence.Flag ≠ #bid THEN RETURN;
               Last.Key.Flag = #suitkey;
               CALL Clear_Suit;
               Spade.Light = #on;
               RETURN;
               END;

$NT:           PROCEDURE;
               IF Sequence.Flag ≠ #bid THEN RETURN;
               Last.Key.Flag = #suitkey;
               CALL Clear_Suit;
               NT.Light = #on;
               RETURN;
               END;

$DBL:          PROCEDURE;
               IF Sequence.Flag ≠ #bid THEN RETURN;
               Last.Key.Flag = #dblkey;
               IF Doubled.Light= #on THEN
                    BEGIN; Doubled.Light = #off;
                           Redoubled.Light = #off;
                           Doubled.Flag = #1;
                    END;
               ELSE BEGIN; Doubled.Light = #on;
                           Doubled.Flag = #2;
                    END;
               RETURN;
               END;
```

```
            /* ----- CHANGE STATE OF THE REDOUBLED LIGHT AND DOUBLED LIGHT IF INDICATED - */
$RDBL:      PROCEDURE;
            IF Sequence.Flag ≠ #bid THEN RETURN;
            Last.Key.Flag = #rdblkey;
            IF Redoubled.Light = #on THEN
                 BEGIN; Redoubled.Light = #off;
                        IF Doubled.Flag = #1 THEN Doubled.Light = #off;
                 END;
            ELSE BEGIN; Redoubled.Light = #on;
                        Doubled.Light = #on;
                 END;
            RETURN;
            END;

            /* ----- ADD 100 TO DECLARERS SCORE ----- */
$100:       PROCEDURE;
            IF Sequence.Flag = #bid THEN Sequence.Flag = #bidhonors;
            ELSE IF Sequence.Flag = #endmade THEN Sequence.Flag = #madehonors;
                 ELSE RETURN;
            Last.Key.Flag = #honorskey;
            CALL Store_State;
            IF We.Light = #on THEN We.Score.Display = We.Score.Display + 100;
            IF They.Light = #on THEN They.Score.Display = They.Score.Display + 100;
            RETURN;
            END;

            /* ----- ADD 150 TO DECLARERS SCORE ----- */
$150:       PROCEDURE;
            IF Sequemce.Flag = #bid THEN Sequence.Flag = #bidhonors;
            ELSE IF Sequence.Flag = #endmade THEN Sequence.Flag = #madehonors;
                 ELSE RETURN;
            Last.Key.Flag = #honorskey;
            CALL Store_State;
            IF We.Light = #on THEN We.Score.Display = We.Score.Display + 150;
            IF They.Light = #on THEN They.Score.Display = They.Score.Dispaly + 150;
            RETURN;
            END;

            /* ----- ACT ON NUMBER INPUT BASED ON SEQUENCE FLAG:
                            BID SEQUENCE - DISPLAY NUMBER IN CONTRACT BID DISPLAY
                            ENTER SEQUENCE - ENTER NUMBER INTO INDICATED DISPLAY
                            MADE SEQUENCE - UPDATE SCORES BASED ON BID AND PLAY RESULTS - */
$NUMBER:    PROCEDURE(nkey);      /* nkey is the key number struck */
            GO TO (n_bid,n_honor,n_endmade,n_enter,n_made,n_honor), Sequence.Flag;

            /* BID */
n_bid:      Contract.Bid.Display = nkey;
            GO TO End123;

            /* HONOR OR ENDMADE */
n_honor: n_endmade: RETURN;

            /* ENTER */
n_enter:    IF We.Light = #on THEN
                 IF Enter.Flag = #1 THEN
                      IF Last.Key.Flag = #enterkey THEN We.Score.Display = nkey;
                      ELSE We.Score.Display = MOD(10*We.Score.Display,100000)+ nkey;
                 ELSE IF Last.Key.Flag = #enterkey THEN We.Partscore.Display = nkey;
                      ELSE We.Partscore.Display = MOD(We.Partscore.Display*10,100)   + nkey;
            IF They.Light = #on THEN
                 IF Enter.Flag = #1 THEN
                      IF Last.Key.Flag = #enterkey THEN They.Score.Display = nkey;
                      ELSE They.Score.Display = MOD(10*They.Score.Display,100000)+ nkey;
                 ELSE IF Last.Key.Flag = #enterkey THEN They.Partscore.Display = nkey;
                      ELSE They.Partscore.Display=MOD(10*They.Partscore.Display,100)  +nkey;
            GO TO End123;

            /* MADE */
n_made:     IF We.Light = #on THEN
                 BEGIN; vulnerable = We.Vulnerable.Light;
                        defense.vulnerable =They.Vulnerable.Light;
                 END;
            ELSE IF They.Light = #on THEN
                 BEGIN; vulnerable = They.Vulnerable.Light;
                        defense.vulnerable = We.Vulnerable.Light; END;
                 ELSE RETURN;
            /* vulnerable is offensive vulnerable status, defense.vulnerable is
               defensive vulnerable status, n is number of tricks taken   */
```

```
n = nkey;
IF Made.Flag = #1 THEN n = n + 6;
IF n > 13 THEN RETURN;
CALL Store_State;
IF n < Contract.Bid.Display + 6 THEN GO TO down;

/* MADE CONTRACT, COMPUTE SCORE AND OVERTRICK, DOUBLE, & SLAM PREMIUMS */
/* points is below-the-line points, premium is above-the-line points */

/* Compute Below-the-line Score */
IF Club.Light = #on | Diamond.Light = #on THEN trick.value = 20;
                                           ELSE trick.value = 30;
points = trick.value*Contract.Bid.Display;
IF NT.Light = #on THEN points = points + 10;
IF Doubled.Light = #on THEN points = 2 * points;
IF Redoubled.Light = #on THEN points = points * 2;
IF We.Light = #on THEN points = points + We.Partscore.Display;
                  ELSE points = points + They.Partscore.Display;

/* Compute Slam Premiums */
IF Contract.Bid.Display => 6 THEN
     IF vulnerable = #on THEN premium = 750;
                         ELSE premium = 500;
ELSE                          premium = 0;
IF Contract.Bid.Display = 7 THEN premium = premium * 2;
IF Doubled.Light = #on THEN premium = premium + 50;

/* Compute Overtrick Premiums */
IF n ≠ Contract.Bid.Display + 6 THEN
     BEGIN; IF Doubled.Light = #on THEN
          BEGIN; IF Redoubled.Light = #on THEN overtrick.value = 200;
                                           ELSE overtrick.value = 100;
                 IF vulnerable = #on THEN overtrick.value = overtrick.value * 2:
          END;
            ELSE overtrick.value = trick.value;
            premium = premium + overtrick.value*(n-6-Contract.Bid.Display);
     END;
defense.premium = 0;

/* COMPUTE RUBBER AND GAME PREMIUMS */
/* For Contract Bridge, score premiums for a rubber if a game won and side is
vulnerable.  For Duplicate and Chicago score premiums for games and partscores
(partscore premium in Chicago only if 4-th hand in rubber).
This section changes the meaning of points to be the number of points
for the offensive partscore, and of premium to the number of points added to
the offensive score   */

IF points => 100 THEN
     IF Game.Switch = #contract THEN
          BEGIN; IF vulnerable = #on THEN
                     BEGIN; IF defense.vulnerable = #on THEN premium=premium+500
                                                      ELSE premium=premium+700
                            vulnerable = #off;
                            defense.vulnerable = #off;
                     END;
                  ELSE vulnerable = #on;
                  premium = premium + points;
                  points = 0;
          END;
     ELSE BEGIN; IF vulnerable = #on THEN premium = premium + points + 500;
                                     ELSE premium = premium + points + 300;
                 points = 0;
          END;
IF points > 0 THEN
     IF Game.Switch = #chicago & vulnerable = #on & defense.vulnerable = #on THE
          BEGIN; premium = premium + points + 100;
          THEN   points = 0;
          END;
     ELSE IF Game.Switch = #duplicate THEN
                BEGIN; premium = premium + points + 50;
                       points = 0;
                END;
GO TO Update;

/* WENT DOWN. COMPUTE PENELTY PREMIUMS FOR THE DEFENSE */
/* points is set to amount t of to offensive partscore and premium is
   amount to add to offensive score.   */
```

```
down:       IF We.Light = #on THEN points = We.Partscore.Display;
                              ELSE points = They.Partscore.Display;
            premium = 0;
            IF Doubled.Light = #on THEN
                 BEGIN; IF vulnerable.= #on THEN
                            defense.premium = (Contract.Bid.Display+5-n)*300 + 200;
                        ELSE defense.premium= (Contract.Bid.Display+5-n)*200 + 100;
                        IF Redoubled.Light = #on THEN defense.premium = 2 * defense.premium;
                 END;
            ELSE IF vulnerable = #on THEN
                       defense.premium = (Contract.Bid.Display+6-n)*100;
                 ELSE  defense.premium = (Contract.Bid.Display+6-n)*50;

         /* UPDATE SCORES AND PARTSCORES BASED ON GAME AND POINTS,PREMIUM,&DEFENSE.PREMIUM*/
Update:     IF We.Light = #on THEN
                 BEGIN; We.Score.Display = We.Score.Display + premium;
                        We.Partscore.Display = points;
                        IF points = 0 & defense.premium = 0 THEN
                            BEGIN; They.Score.Display = They.Score.Display + They.Partscore.
                                   They.Partscore.Display = 0;                    Display;
                            END;
                        ELSE They.Score.Display = They.Score.Display + defense.premium;
                        We.Vulnerable.Light = vulnerable;
                        They.Vulnerable.Light = defense.vulnerable;
                 END;
            ELSE BEGIN; They.Score.Display = They.Score.Display + premium;
                        They.Partscore.Display = points;
                        IF points = 0 & defense.premium=0 THEN
                            BEGIN; We.Score.Display = We.Score.Display +We.Partscore.Display;
                                   We.Partscore.Display = 0;
                            END;
                        ELSE We.Score.Display = We.Score.Display + defense.premium;
                        They.Vulnerable.Light = vulnerable;
                        We.Vulnerable.Light = defense.vulnerable;
                 END;

         /* UPDATE VULNERABILITY FOR CHICAGO */
            IF Game.Switch = #chicago THEN
                 IF We.Vulnerable.Light = #on THEN
                      IF They.Vulnerable.Light = #on THEN
                            BEGIN; We.Vulnerable.Light = #off;
                                   They.Vulnerable.Light = #off;
                            END;
                      ELSE BEGIN; We.Vulnerable.Light = #off;
                                  They.Vulnerable.Light = #on;
                                  We.Score.Display = We.Score.Display+We.Part Score.Display;
                                  We.Part Score.Display = 0;
                                  They.Score.Display = They.Score.Display+
                                  They.Part Score.Display;
                                  They.Part Score.Display = 0;
                            END;
                 ELSE We.Vulnerable.Light = #on;

         /* End of n_made processing */
            Sequence.Flag = #endmade;

         /* End of $NUMBER processing */
End123:     Last.Key.Flag = #numberkey;
            RETURN;
            END;


/*****************************************************************************/
/*              SECOND LEVEL PROCEDURES                                      */
/*****************************************************************************/

            /*---------- RESTORE SCORES TO PREVIOUS STATE ----------*/
Restore_Display: PROODURE;
            We.Score.Display = We.Score.State;
            They.Score.Display = They.Score.State
            We.Partscore.Display = We.Partscore.State;
            They.Partscore.Display = They.Partscore.State;
            We.Vulnerable.Light = We.Vulnerable.State:
            They.Vulnerable.light = They.Vulnerable.State;
            RETURN;
         END;
```

```
        /*---------- SET SCORES TO INITIAL STATE ----------*/
Clear_Display: PROCEDURE;
        We.Score.Display = 0;
        They.Score.Display = 0;
        We.Partscore.Display = 0;
        They.Partscore.Display = 0;
        We.Vulnerable.Light = #off;
        They.Vulnerable.Light = #off;
        Made.Flag = #1;
        Enter.Flag = #1;

        Sequence.Flag = #endmade;
        CALL Clear_Contract;
        RETURN;
    END;
        /*----------- SAVE SCORES -----------*/
Store_State: PROCEDURE;
        We.Score.State = We.Score.Display;
        They.Score.State = They.Score.Display;
        We.Partscore.State = We.Partscore.Display;
        They.Partscore.State = They.Partscore.Display;
        We.Vulnerable.State = We.Vulnerable.Light;
        They.Vulnerable.State = They.Vulnerable.Light;
        RETURN ;
    END;
        /*----------- CLEAR BID INDICATORS ----------*/
Clear_Contract: PROCEDURE;
        We.Light = #off;
        They.Light = #off;
        Contract.Bid.Display = 0;
        Doubled.Light = #off;
        Doubled.Flag = #1;
        Redoubled.Light = #off;
        CALL Clear_Suit;
        RETURN;
    END;
        /*---------- CLEAR SUIT LIGHTS -----------*/
Clear_Suit: PROCEDURE;
        Club.Light = #off;
        Diamond.Light = #off;
        Heart.Light = #off;
        Spade.Light = #off;
        NT.Light = #off;
        RETURN;
    END;
```

Conclusions

The Automatic Bridge Score Calculator and Display described herein represents the best known use of the invention and incorporates all of the principle features of the invention. However, it should be understood that this embodiment and the great many details of construction and operation of the embodiment is made by way of example to show a useful application of the invention. Many of the concepts described herein, the structural details and the procedures involved in this embodiment can be incorporated into a calculator which includes other computational capabilities in addition to those described in this embodiment. For example, add, subtract, multiply and divide capabilities can be incorporated into the calculator as well as a timer to measure the time of play. Furthermore, any of the perameters displayed by the calculator can be also displayed in printed form or projected or displayed in alpha numeric form on a cathode ray tube or similar type of device. Finally, it should be kept in mind that the embodiment described herein is suitable for scoring and displaying scores in Contract Bridge, Duplicate Bridge, and Chicago Bridge, according to the presently prevailing rules for these games of bridge. Clearly, the calculator described herein can be changed to accommodate changes in the rules and could be modified to accommodate other bridge-type games not specifically mentioned or described herein, all within the spirit and scope of the present invention set forth by the appended claims.

What is claimed is:

1. An electrical computer for computing the score of at least one of the parties engaged in the card game called Bridge, or the like, in which a hand of the game is dealt to the parties, bid upon by the parties, and played by the parties, each party taking tricks during the play, comprising, (a) manually operated means for initiating the storage of electrical signals representative of the winning bid before the hand is played by the parties, (b) manually operated means for initiating the production of electrical signals representative of the tricks taken during the play by the party winning the bid and (c) means responsive to all of said signals for computing the change in the score of the party winning the hand.

2. An electrical computer as in claim 1 further comprising manually operated means for initiating the storage of electrical signals during the hand of the game, at the conclusion of the bidding representative of whether a change in the score of the party winning the bid as a result of the play of the hand is to be doubled or redoubled.

3. An electrical computer as in claim 1 further comprising manually operated means for initiating the storage of electrical signals at the end of the play of the hand representative of whether either party scores honors in the play of the hand.

4. An electrical computer as in claim 1 further including ·

(a) means for storing electrical signals representative of the total score of successive hands of the game for each party, (b) means for computing and storing electrical signals representative of each party's part score for successive hands of the game and (c) means for comparing said stored electrical signals representing part scores with reference signals to determine if a party has won a game, (d) said comparing means producing signals indicative of whether a party is vulnerable.

5. An electrical computer as in claim 1 wherein means are provided for computing each party's premium score for successive hands of the game producing electrical signals indicative of each party's total point score.

6. An electrical computer as in claim 1 wherein, means are provided for counting the number of hands played.

7. An electrical computer as in claim 1 further comprising, (a) manually operated means for initiating the storage of electrical signals during the hand of the game at the conclusion of the bidding representative of whether a change in the score as a result of the play of the hand of the party winning the bid is to be doubled or redoubled, (b) manually operated means for initiating the storage of electrical signals at the end of the play of the hand representative of whether either party scores honors in the play of the hand, (c) means for storing electrical signals representative of the total score of successive hands of the game for each party, (d) means for computing and storing electrical signals representative of each party's part score for successive hands of the game and, (e) means for comparing said stored electrical signals representing part scores with reference signals to determine if a party has won a game, (f) said means for comparing producing electrical signals indicative of whether a party is vulnerable, (g) means for storing electrical signals representative of each party's total point score for successive hands and (h) means responsive thereto for producing electrical signals indicative of each party's accumulated total point score.

8. An electrical computer as in claim 7 wherein, (a) means are provided for displaying said part scores and said total accumulated point scores.

9. An electrical computer as in claim 8 wherein, (a) means are provided for displaying the following:

(b) whether a change in the score of a party is to be doubled or redoubled and (c) whether either party is vulnerable.

10. An electrical computer as in claim 7 wherein, (a) means are provided for displaying said part scores and said total accumulated point scores and (b) mmeans are provided for displaying the following:

(c) whether a change in the score of a party is to be doubled or redoubled and (d) whether either party is vulnerable.

11. An electrical computer as in claim 1 wherein, (a) said means for computing is a micro processor that includes:

(b) read only memory (ROM) storage means for storing fixed instructions at designated addresses therein and producing instruction signals when addressed;

(c) a micro processing unit that responds to said instruction signals from the ROM storage means and executes said instructions producing computed score signals and (d) random access memory (RAM) storage means for storing said computed score signals
(e) whereby the scores of the parties are computed and stored.

12. An electrical computer as in claim 1 wherein,
(a) means are provided for displaying said scores
(b) said means for computing is a micro processor that includes:
(c) read only memory (ROM) storage means for storing fixed instructions at designated addresses therein and producing instruction signals when addressed,
(d) a micro processing unit that responds to said instruction signals from the ROM storage means and executes said instructions producing computed score signals,
(e) random access memory (RAM) storage means for storing said computed score signals and
(f) means responsive to signals from said ROM and RAM storage means and said micro processing unit for transferring said computed score signals to said display means,
(g) whereby the scores of the parties are displayed.

13. An electrical computer as in claim 12 wherein,
(a) the manually operated means is a multitude of manually operated switches intended for operation one at a time and
(b) the manual operation of a switch produces an input signal to the micro processing unit and an input signal to the RAM storage means,
(c) whereby the scores of the parties are computed and displayed in accordance with the sequence of operation of the manually operated switches.

14. An electrical computer as in claim 13 wherein,
(a) the multitude of manually operated switches defines a matrix of rows and columns of electrical lines,
(b) whereby manual operation of a switch electrically connects a given row electrical line to a given column electrical line,
(c) means are provided for electrically scanning the column electrical lines in a given sequence while a switch is manually operated,
(d) means are provided for electrically scanning the row electrical lines in a given sequence while the same switch is manually operated and
(e) means are provided responsive to said scans for determining which switch in the matrix is manually operated.

15. An electrical computer as in claim 1 further including
(a) means for storing electrical signals representative of the total score of successive hands of the game for each party,
(b) means for producing signals representative of each party's part score for successive hands of the game and
(c) means for producing signals indicative of whether a party is vulnerable.

16. An automatic electrical calculator for computing and displaying the scores of two parties identified as WE and THEY engaged in the card game called "Bridge" or the like, in response to inputs by the parties during the course of play comprising,
(a) a key board suitable for manual operation by the parties for initiating electrical input signals representative of the declaring party and the declaring party's bid at the beginning of each hand of the game, the number of tricks over book taken by the declaring party at the end of the hand and the number of honor points awarded each party at the end of the hand,
(b) a digital computer responsive to said input signals for computing the part score for each party and the total accumulated point score for each party and for storing signals representative of said scores, and
(c) a decimal display responsive to said stored scores for displaying the scores to the parties.

17. An electrical computer as in claim 16 wherein,
(a) the computer includes at least one random access memory (RAM), at least one read only memory (ROM) and a micro processing unit which together constitute a micro processor,
(b) the micro processing unit having the capability to execute instructions stored in the ROM,
(c) said micro processor being constructed to incorporate therein a predetermined program,
(d) said predetermined program being such that the micro processor responds to said inputs and computes and stores said signals representative of the parties scores in accordance with the rules of said game.

* * * * *